United States Patent [19]

Dickey

[11] 4,213,616

[45] Jul. 22, 1980

[54] FOUR-IN-A-ROW BOARD GAME

[76] Inventor: Thomas E. Dickey, Stanardsville, Va. 22973

[21] Appl. No.: 53,806

[22] Filed: Jul. 2, 1979

[51] Int. Cl.[3] ..... A63F 3/00

[52] U.S. Cl. ..... 273/271

[58] Field of Search ..... 273/239, 264, 269, 270, 273/271; 35/7 A

[56] References Cited

U.S. PATENT DOCUMENTS

| | | | |
|---|---|---|---|
| 1,521,095 | 12/1924 | Harris | 273/271 |
| 1,564,746 | 12/1925 | Barnard | 273/271 |
| 1,655,380 | 1/1928 | Parker | 273/269 |
| 2,511,774 | 6/1950 | Goldsmith | 273/239 |
| 3,093,919 | 6/1963 | Holtz | 273/239 |
| 3,628,261 | 12/1971 | Thompson | 273/155 X |
| 4,138,120 | 2/1979 | Daitzman | 273/271 |

OTHER PUBLICATIONS

Science Bingo Series, Cleo Learning Aids Catalog, Feb. 1976.

6 Unique Bingo Games, Cleo Learning Aids Catalog, Feb. 1976.

*Primary Examiner*—Harland S. Skogquist

*Attorney, Agent, or Firm*—A. W. Breiner

[57] ABSTRACT

A board game comprising a gameboard divided into sixteen units arranged in four vertical and four transverse rows, each of said units having indicia thereon randomly arranged on the board selected from four sets of indicia. There are also sixteen cards having indicia thereon corresponding to the indicia on the sixteen units of the gameboard. At least two sets of markers are provided for placing on the sixteen units of the gameboard. In play each player sequentially picks a card from the sixteen cards and places a marker on a unit of the gameboard corresponding to the indicia on the card. The object of the game is for a player to have four markers in a row on the gameboard. The game is easy to play, can be completed in a short period of time, and provides for a good combination of luck and skill.

10 Claims, 4 Drawing Figures

FOUR-IN-A-ROW BOARD GAME

FIELD OF INVENTION AND BACKGROUND

The present invention is directed to a board game and more particularly to a board game which uniquely utilizes the features or characteristcs of tic-tac-toe, bingo, and playing cards.

Games such as tic-tac-toe based on the concept of having a plurality of X's or O's or similar indicia in a straight line as an essential feature are known. Such games are entertaining and require some degree of skill on the part of the players. Board games such as bingo where the object is to fill all of the squares on a board or all of the squares on the board which are in a straight line are also known. Such games are based substantially on luck. Games are also known which utilize a gameboard and a pack of cards where the player's activity on the gameboard is determined or based on the pick of a card. Such games involve varying degrees of skill and also an element of luck. However, such games are usually based on complex rules and require a substantial period of time for completion. Accordingly, there is a need for a board game for the casual or young player which utilizes a combination of skill and luck, but is easy to learn and can be completed in a short period of time.

OBJECTS AND GENERAL DESCRIPTION

Accordingly, it is a primary object of this invention to provide a board game which has a good combination of luck and skill; is extremely easy to play, and is completed in a short time period.

The primary object as aforestated and other objects are accomplished by providing a gameboard having sixteen numbers or other indicia arranged in four vertical and four horizontal rows. The sixteen numbers or other indicia are made up from four sets of indicia, i.e., the numbers 1, 2, 3 and 4; each of the numbers 1, 2, 3 and 4 being repeated four times. The four numbers are arranged on the board preferably in order that each number of the four sets appears in each of the vertical and horizontal rows, and diagonally only once, i.e., the sequence—

| | | | |
|---|---|---|---|
| 2 | 3 | 4 | 1 |
| 4 | 1 | 2 | 3 |
| 1 | 4 | 3 | 2 |
| 3 | 2 | 1 | 4 |

The game further requires sixteen cards corresponding to the sixteen numbers or other indicia on the board. In the above example using four sets of the numbers 1, 2, 3 and 4, four of the cards will bear the number 4; four of the cards will bear the number 3; four of the cards will bear the number 2, and four of the cards will bear the number 1. The sixteen cards are constructed to permit shuffling or the like so that the numbers of the sets are randomly arranged. Finally, the board game requires sixteen markers arranged in two or more sets for covering the squares of the board.

The game can be played by two or more players. The number of players determines the number of sets of markers. If there are two players, each player will select a marker of his choice, i.e., a round or square marker. The first player will then take a first card from the shuffled stack of cards and if it bears the number 4 will place it on any one of the four squares on the gameboard bearing the number 4. The second player will then take a card from the stack of cards and will again place a marker on any square on the board corresponding to the number on the card. The selection procedure is repeated until the last card has been drawn and the board is completely filled, or until one of the players fulfills the objective of the game and has four of his markers arranged in either a vertical, transverse, or diagonal straight line on the board. There are no other essential rules of the game. However, it is permissible to include various other rules as, for example, utilizing a scoring procedure for playing a set of games whereby the first player scoring the number 11 or 21, as an example, is the winner. With such scoring procedure, a "win," where four markers are arranged in a row, could be worth five points; three markers in a row could be worth three points, and two markers in a row could be worth one point.

As is apparent, the game having few rules is simple to play and is easily learned including by young players. As also apparent, a game or a set of games can be completed in a short period of time, accommodating a busy schedule or a short attention span. However, as will also be apparent, there can be substantial skill involved in the play. For example, the game can involve the skill of blocking of an opponent to prevent a win, or to minimize the number of points awarded to the player. The skill aspects of the game can be enhanced by using markers which completely cover the numbers or other indicia on the board and having a rule where the marker once placed cannot be moved. In this way the players must either remember the numbers which have been played, and/or memorize the sequence of numbers on the board.

BRIEF DESCRIPTION OF THE DRAWING

In the drawing,

Referring now to the drawing where like numerals are used to designate like elements throughout the various figures, the board is generally designated by the numeral 10. As seen, there are sixteen square units, 12 on the board. The board is arranged into four transverse rows and four vertical rows. Round markers 16 and square markers 18 are utilized to designate units of the board which the players have elected to cover corresponding to the numbers on the cards picked from the stack of cards made up of the four number sets 20, 22, 24 and 26 shown in FIG. 2. As shown in FIG. 1, the round markers 16 are arranged in a row with the phantom line designating a win.

Figure 1:
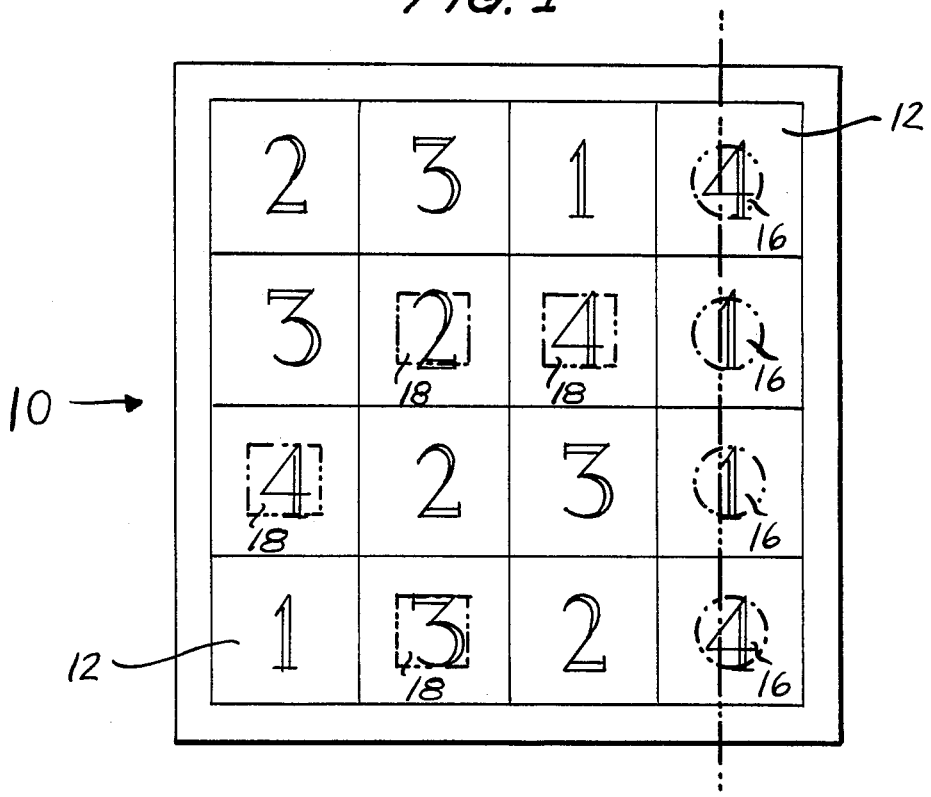
FIG. 1 shows a typical gameboard illustrating an array of numbers on the gameboard and having markers shown in phantom lines on certain of the numbers.
Figure 2:
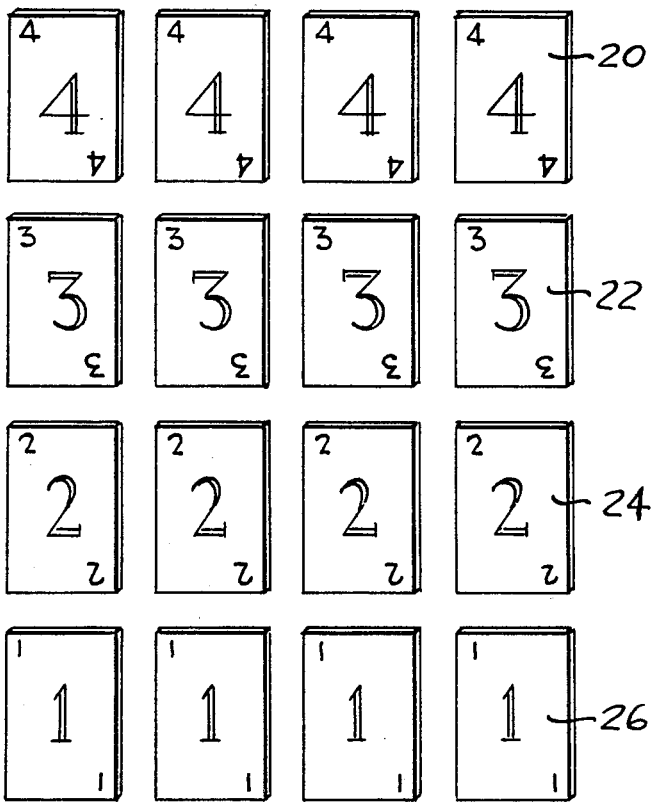
FIG. 2 shows the arrangement of cards corresponding to the number sets shown in FIG. 1.
Figure 3:
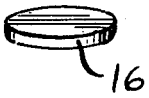
FIG. 3 illustrates a marker for a first player.
Figure 4:
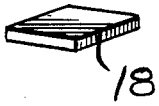
FIG. 4 illustrates a marker for a second player.

In the random array of numbers shown in FIG. 1, the numbers 1 and 4 appear twice in the same vertical row. This array provides for an entertaining game. It is presently believed, however, that it is preferred to have the numbers arranged in order that no number or indicia is repeated in any vertical, horizontal or diagonal row. Arrays of numbers meeting this category, as an example only, can be the following:

| | | | | | | | | | | | |
|---|---|---|---|---|---|---|---|---|---|---|---|
| 1 | 2 | 3 | 4 | 1 | 3 | 2 | 4 | 1 | 3 | 4 | 2 |
| 3 | 4 | 1 | 2 | 2 | 4 | 1 | 3 | 4 | 2 | 1 | 3 |
| 4 | 3 | 2 | 1 | 4 | 2 | 3 | 1 | 2 | 4 | 3 | 1 |
| 2 | 1 | 4 | 3 | 3 | 1 | 4 | 2 | 3 | 1 | 2 | 4 |
| 1 | 2 | 4 | 3 | 1 | 4 | 2 | 3 | 1 | 4 | 3 | 2 |
| 4 | 3 | 1 | 2 | 2 | 3 | 1 | 4 | 3 | 2 | 1 | 4 |
| 3 | 4 | 2 | 1 | 3 | 2 | 4 | 1 | 2 | 3 | 4 | 1 |
| 2 | 1 | 3 | 4 | 4 | 1 | 3 | 2 | 4 | 1 | 2 | 3 |

As will be apparent, although the board game has been described utilizing the sets of numbers 1, 2, 3 and 4, the numbers can be replaced with any indicia such as sets of letters, i.e., the letters A, B, C and D; or colors, i.e., the colors green, red, blue and yellow; or by pictures such as four sets of sixteen cars, i.e., a Ford car, a Buick car, a Chevrolet car and a Mercury car; or by four sets of animals, i.e., horses, cows, dogs and cats. The use of pictures or colors as the indicia can be appealing to the younger player.

As will also be apparent, the gameboard can be made of various materials such as pressed paperboard, plastic, wood or the like. Moreover, the game can be constructed from common paper as, for example, a tear-out in a magazine, with the cards and markers of the game being provided in sheet form, removed from the sheet by cutting along or tearing along perforations on the sheet. This will permit the use of the gameboard as an insert in airline magazines or the like for use during flight. It also may be preferable at times to utilize magnetized components for play of the board game on the beach or the like. When using a magnetized game, the gameboard will be of one polarity and the markers of a different polarity to provide the necessary attraction. Furthermore, although the board game is described with respect to a gameboard divided into sixteen units to provide four vertical and four transverse rows which is the preferred board game, it is possible to utilize more than four vertical and more than four transverse rows. However, fewer than four vertical and four transverse rows provides an unacceptable game from the standpoint of suspense with respect to the winner. As acceptable alternatives, the board can be arranged to have five vertical and five transverse rows, dividing the board into twenty-five units. In this arrangement the first player will have an extra turn. As a further acceptable alternative, the board can be divided into six vertical rows and six transverse rows, dividing the board into thirty-six units. More than six vertical and six transverse rows causes the game to become cumbersome and requires a prolonged period of time for play and, accordingly, are not acceptable. The aforesaid and other modifications being within the ability of one skilled in the art are to be covered by the present invention.

It is claimed:

1. A board game comprising (1) a gameboard, said board being divided into sixteen units only to provide four vertical and four transverse rows, each of said sixteen units having indicia thereon, the indicia on said sixteen units comprising four individual sets of indicia and the units in at least each of said vertical or each of said transverse rows including each of said four sets of indicia of four each; (2) sixteen cards having indicia thereon in toto corresponding to the indicia on said sixteen units of said gameboard; and (3) sixteen markers in at least two sets for placing on and distinguishing selected units of said sixteen units of said gameboard.

2. The board game of claim 1 wherein the indicia are arranged whereby the indicia does not repeat in any vertical, transverse, or diagonal row.

3. The board game of claim 2 wherein the four sets of indicia are the numbers 1, 2, 3 and 4.

4. The board game of claim 3 wherein there are two sets of eight markers.

5. The board game of claim 2 wherein said board and markers are magnetic, the markers being of one polarity and the gameboard being of the other polarity.

6. The board game of claim 1 wherein the four sets of indicia are letters.

7. The board game of claim 1 wherein the four sets of indicia are pictures.

8. The board game of claim 7 wherein the four sets of indicia are each of cars, with said cars of each set being of distinct shape with respect to the other sets.

9. The board game of claim 7 wherein the four sets of indicia are of animals, with the animals of each set being of a distinct kind with respect to the other sets.

10. A board game comprising (1) a gameboard, said board being divided into W units only to provide X vertical and X transverse rows, each of said units having indicia thereon, the indicia on said W units comprising X individual sets of indicia and the units in at least each of said vertical or each of said transverse rows including each of said X sets of indicia of X each; (2) W cards, each of said W cards having indicia thereon in toto corresponding to the indicia on each of said W units of said gameboard; and (3) W markers in at least two sets for placing on and distinguishing selected units of said W units of said gameboard, W being 16, 25 or 36 and X being 4, 5 or 6.

* * * * *